United States Patent [19]

Mikulas

[11] 4,009,065

[45] Feb. 22, 1977

[54] METHOD FOR SPLICING STRIP ENDS TOGETHER

[75] Inventor: Budai Mikulas, St. Gallen, Switzerland

[73] Assignee: Ferd. Ruesch AG, St. Gallen, Switzerland

[22] Filed: Oct. 10, 1974

[21] Appl. No.: 513,751

[30] Foreign Application Priority Data

Oct. 13, 1973 Germany .....2351533

[52] U.S. Cl. ..... 156/159; 156/248; 156/289; 156/304; 428/61

[51] Int. Cl.[2] ..... B31F 5/06

[58] Field of Search ..... 156/157, 159, 289, 304, 156/502, 505, 258, 535, 182, 248, 344; 428/60, 61

[56] References Cited

UNITED STATES PATENTS

| | | | |
|---|---|---|---|
| 3,589,959 | 6/1971 | Sander et al. | 156/159 |
| 3,762,028 | 10/1973 | Swearingen et al. | 156/306 |

FOREIGN PATENTS OR APPLICATIONS

| | | | |
|---|---|---|---|
| 661,283 | 11/1951 | United Kingdom | 156/157 |

*Primary Examiner*—Charles E. Van Horn
*Assistant Examiner*—M. G. Wityshyn
*Attorney, Agent, or Firm*—Kenyon & Kenyon Reilly Carr & Chapin

[57] ABSTRACT

Composite strips are spliced end-to-end each composite strip being formed by a first strip having a pressure-sensitive adhesive inner side and a second strip having an adhesive-repellent inner side on which the first strip's inner side is stuck for easy subsequent removal. To form the splice, a length of the first strip having the pressure-sensitive adhesive inner side is removed from one of the composite strip ends so as to leave a length of the second strip extending therefrom with its adhesive-repellent inner side exposed, this length of the second strip being lapped on the adjacent outside of the other of the composite strip ends while positioning the composite strip ends to form the joint and with this length spanning the joint. Thereafter, flexible splicing pieces are applied spanning the joint on both sides with the one on the side of the lapped length of the second strip extending therebeyond so it is stuck on the outside of the lapped composite strip's outside. Therefore, if the joint is not tightly made, during the pressure application of the splicing pieces they cannot adhere together in any space between the composite strip ends, because they are separated by the extending portion of the second strip having the pressure-repellent inner side. This permits easy subsequent removal of the first strip or portions thereof from the second strip throughout the area of the splice.

2 Claims, 6 Drawing Figures

Fig.1
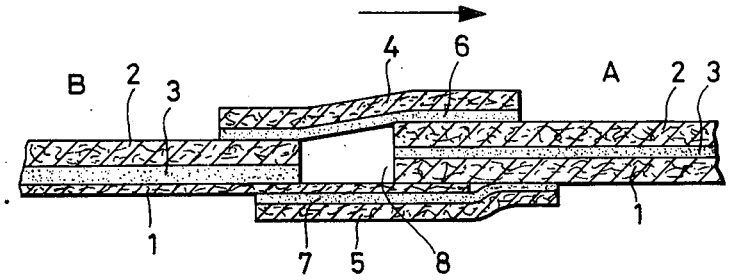
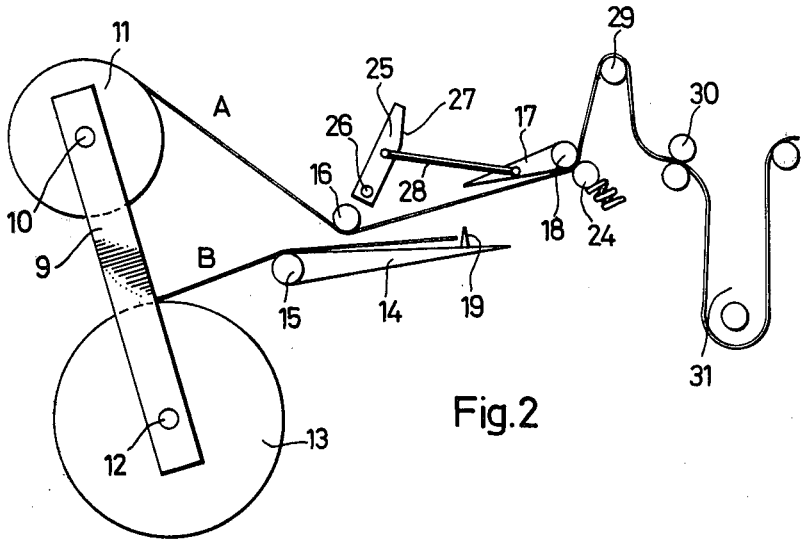
Fig.2

Fig. 3
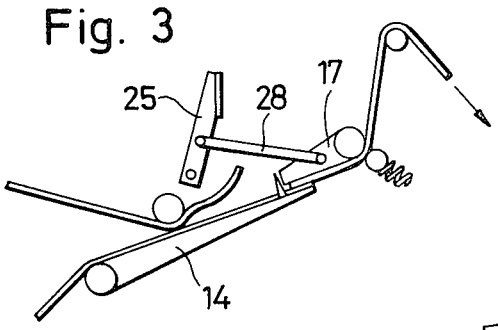
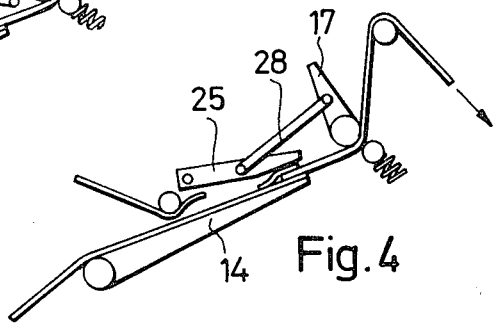
Fig. 4
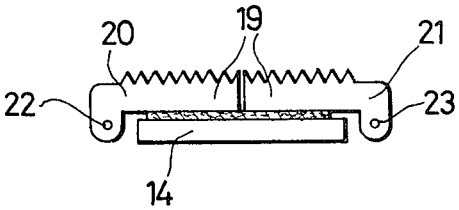
Fig. 5
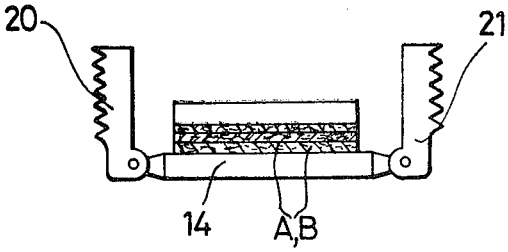
Fig. 6

METHOD FOR SPLICING STRIP ENDS TOGETHER

BACKGROUND OF THE INVENTION

Self-stick labels are made with the label having pressure-sensitive adhesive on one side. A protective layer of paper or synthetic material is removably stuck on that side. The protective layer has an adhesive repellent side on which the label is stuck for easy subsequent removal when the label is used.

To make such labels, a composite strip of the label and protective layer materials, stuck together, are continuously fed to an automatic punching machine which punches out the label contours while leaving the protective layer material strip intact to function as a carrier for conveying the punched labels onward. The punching operation produces a lattice of the label material which is peeled off of the strip of protective layer material at the punching machine.

The machine is supplied by coils of such composite strip mounted so that as one coil becomes exhausted it is replaced by another coil, the trailing end of the strip from the exhausting coil necessarily requiring splicing to the leading end of the strip from the unused coil. A storage loop can be formed in the composite strip between the punching machine and the splicing location so that at that location the composite strip can be momentarily stopped for the splicing operation, but such stopping is for short duration and requires rapid splicing.

It is possible to splice the composite strip ends together by positioning them to form an end-to-end joint and applying splicing pieces in the form of short lengths of strip having pressure-sensitive surfaces which are stuck on both outsides of both composite strip ends and with the splicing pieces spanning the joint. For firmness, the splicing pieces much be pressed towards each other on the composite strips' surfaces.

The above splice can be made quickly, but if the joint is not tightly made, a space is formed between the ends of the two composite strips, and when the splicing pieces are pressed together, it is possible for their adhesive surfaces to inter-contact and become joined together. In that event, when the punched-out lattice is pulled from the strip of protective layer material from the latter's adhesive-repellent surface, the lattice is torn apart at the splice because there the lattice is joined too firmly to the strip of protective layer material, which is functioning as a carrier strip, because at the splice the lattice is connected by the two interjoined splicing pieces to the outside which provides good adherence for pressure-sensitive adhesive, because it has not been treated to make it adhesive-repellent.

SUMMARY OF THE INVENTION

With the above in mind, according to the present invention, prior to the splicing operation, a length of the strip having the pressure-sensitive adhesive is removed from the other strip having the adhesive-repellent inner side, at the leading end of the composite strip coming from the new supply coil, thus forming a length of this strip having the adhesive-repellent inner side, extending forwardly. This extending length is lapped under the trailing end of the composite strip from the exhausted coil and then the splicing pieces are pressed into position to make the splice as described before. Now, if the end-to-end joint is not tightly made, the two splicing pieces are separated by the extending length of strip having the pressure-repellent surface. Therefore, after punching, the lattice can be pulled away from the balance of the composite strip without breaking, because the lattice is connected throughout to this balance only through adhesive-repellent surfaces from which it is easily removed.

BRIEF DESCRIPTION OF THE DRAWINGS

The invention is entirely schematically illustrated by the accompanying drawings, in which:

FIG. 1 is a longitudinal section through the splice of this invention;

FIG. 2 in elevation shows an apparatus for quickly making the splice while the composite strip feed is momentarily stopped;

FIGS. 3 and 4 show elements of the apparatus of FIG. 2 in different stages of operation; and FIGS. 5 and 6 are cross sections of details, showing their action.

DETAILED DESCRIPTION OF THE INVENTION

Referring first to FIG. 1, the trailing end of the exhausting strip is shown at A and the leading end of the strip from a fresh coil is shown at B. Both are composite strips, each consisting of the protective layer strip 1 which functions as a carrier strip and has an inner surface which is siliconized to make it adhesive-repellent, and the strip 2 of the label material and having an inner surface coated with a layer 3 of pressure-sensitive adhesive, stuck on the pressure-repellent layer surface for easy removal therefrom as required for removal of the punched-out lattice of the strip 2 from the strip 1 which functions as the carrier strip, at the punching machine (not shown). Both composite strips are ordinarily of the same thickness, the strip A being shown thicker than the strip B in FIG. 1, to show that the splice may be made even in such instances.

With the two composite strips positioned end-to-end, the two splicing pieces are shown at 4 and 5, respectively having the pressure-sensitive adhesive coatings 6 and 7 so that when the pieces are pressed towards each other while spanning the end-to-end joint, a splice is made. In this instance, the end-to-end joint is not tightly made, there being the intervening space 8. When the pieces are pressed together, the adhesive layer 6 can be pressed into contact with the adhesive layer 7 via the space 8 and in the absence of some kind of protection between the two surfaces.

In accordance with this invention, a portion of the strip 2 with its layer of adhesive 3, of the end B, is cut and removed so that the strip 1 of this end B extends far enough to safely span the joint with its space 8. This extending portion of this strip 1 is made substantially longer than is required to span a tightly-made joint, the exact length on the maximum size of the space to be expected during practical operations. Correspondingly, the splicing pieces 4 and 5 should be made long enough to provide the necessary lengths in such instances. The splicing piece 5 should be long enough to lap a portion of the uncut part of the strip B and to extend beyond the extending length of the strip 1 of B so as to engage the outside of the strip 1 of A, enough for security.

The strip 2 of label material is usually paper having one side coated with the pressure-sensitive adhesive. The carrier strip or protective layer material 1 with its adhesive-repellent inner surface, may also be made of paper, or synthetic material. In other words, the composite strips are flexible. Likewise, the splicing pieces 4 and 5 may be paper or other flexible material coated with pressure-sensitive adhesive, and in any event, they too are flexible. It is for this reason that the pieces 4 and 5 could intercontact under their application pressure via the space 8, if it were not for the extending length of the strip 2 of the composite strip B. This intercontact is prevented, the splicing piece of short strip 4 instead pressing against the adhesive-repellent inner surface of the extending portion of the strip 1 of B, in the case of a loose joint. Therefore, throughout the length of the splice the interjoined strips 2 or any portions thereof can be pulled easily away from the interjoined strips 1 having the inner surfaces which are adhesive-repellent.

The outer surfaces of all of the strips 1 and 2 provide adherence for pressure-sensitive adhesive because they are untreated surfaces. It is to these outside surfaces that the two splicing pieces adhere via their pressure-sensitive adhesive coatings. Therefore, the strips 1, functioning as carrier strips, are securely joined together, and the strips 2 which are peeled away as a lattice at the punching machine, are firmly joined together so that the lattice does not break when pulled at the splicing.

According to this invention, a new apparatus, shown by FIGS. 2 through 6, is provided for making this new splice.

In FIG. 2 a pivotable arm 9 transversely mounts a shaft 10 mounting the exhausting coil 11 of the composite strip, and also a spindle 12 mounting a new coil 13 of such strip. Although not shown, brakes are usually supplied for preventingoverrunning of the coils 11 and 13. The exhausting strip is shown at A and the new strip at B, as in FIG. 1 previously described.

The splicing mechanism comprises a plate 14 which pivots lever-fashion on a shaft 15 extending transversely to the strips, with its free or swinging end pointing away from the oncoming strips from the coils 11 and 13. The strip A goes under a guiding roller 16 to the right above the plate 14 and below a pressure-applying plate 17 pivoted on a transverse shaft 18 and having a free or swinging end pointing opposite to the oncoming strip. This plate 17 and the plate 14 are positioned relatively so that when their free ends are swung together, these ends overlap and are parallel to each other. Near the extreme free end of the plate 14, but spaced from this free end, an upwardly pointing striker-knife 19 is positioned, this being formed by two parts 20 and 21, shown by FIGS. 5 and 6, having upper serrated edges for cutting when in the FIG. 5 position, and which can be separated and swung apart as shown by FIG. 6.

A pressure-applying roller 24 is opposite the shaft 18 at a position holding the strip A against the pressure plate 17.

A sticker 25 is mounted by a transverse shaft 26 above the roller 16 and has a surface 27 on its free end for carrying the splicing piece 4 towards and in alignment with the plate 14 when both the plates 25 and 14 are swung to press their free ends together. This part 25 and the plate 17 are interconnected by a connecting rod 28.

Beyond the pressure plate 17, a guide roller 29 leads the strip to powered pinch rolls 30 feeding a loop 31 provided for strip storage to continuously feed the label punching machine (not shown) when the feed of strip is stopped for the splicing operation.

To make the described splicing with this new apparatus, the end of the strip B from the unused supply coil 13 is layed on the plate 14 after the parts 20 and 21 are swung apart as shown in FIG. 6. Manually, a portion of the strip 2 with its adhesive layer 3 is cut and removed as shown in FIG. 1 and the splicing piece 5 is stuck under its strip 1, again as shown in FIG. 1. Then the parts 20 and 21 of the striker-knife 19 are swung back to clamp the uncut portion of the composite strip B on the plate 14. The upper splicing piece 4 with its adhesive layer 6 is attached to the underside 27 of the sticking plate 25. The apparatus is now ready for automatic splicing. When the coil 11 is about to exhaust, the pressure plate 17 is moved to a down position and the plate 14 is swung to an up position, as shown by FIG. 3, the striker-knife 19 then cutting through the exhausting composite strip A whose forward portion is at the same time pressed against the projecting end of the splicing piece 5 previously applied to the end of the strip B, thus applying the piece 5 to its splicing position as shown in FIG. 1. Then the parts 20 and 21 of the striker-knife 19 are swung outwardly and free from the two strips being spliced together. The pressure plate 17 swings upward and free and, as shown by FIG. 4, through the connecting rod 28 moving the plate 25 carrying the splicing piece 4 on its surface 27, downward so as to press this piece 4 into the position shown by FIG. 1. With the splice completed, all of the parts return to their FIG. 2 positions, the arm 9 is rotated to move the new coil 13 to the position formerly occupied by the exhausted coil 11, and the continuous strip feeding to the punching machine is then continued.

The continuous feeding to the punching machine was in the meantime provided by the storage loop 31 and with the feeding continued from the new coil 13 after the splicing operation, this storage loop again reforms.

There are many arrangements for powering, interconnecting and timing the parts that have been described and all are within the designing ability of persons skilled in the automatic machine art and who have been made acquainted with the foregoing disclosure. To avoid complicating this disclosure, no example of such arrangements have been included in this disclosure.

What is claimed is:

1. A method for splicing the ends of self-stick label composite strips each formed by a label strip comprising a series of labels and having a pressure-sensitive adhesive inner side, and a label carrier strip having an adhesive-repellent treated inner side on which the label strips's inner side is stuck for subsequent separation therefrom, said label and carrier strips having outer sides forming the outsides of the composite strip and providing adherence for pressure-sensitive adhesive, the composite strip ends being positioned to form an end-to-end joint and spliced by applying flexible pieces spanning said joint on both outsides of the composite strips and having pressure-sensitive adhesive surfaces stuck on said outsides of the composite strips by pressing the splicing pieces towards one another; wherein the improvement comprises first removing a length of said label strip from one of said composite strip ends so as to leave a length of said carrier strip extending therefrom with its said adhesive-repellent treated inner side exposed, and via the repellent treated inner side lapping said length of carrier strip on the adjacent outside of the carrier strip of the other of the composite strip ends while positioning the composite strip ends to form said joint and with said length of carrier strip spanning the joint, and then applying said flexible splicing pieces and pressing them towards each other, said length of carrier strip being interposed between the splicing pieces' pressure-sensitive adhesive surfaces in the event said joint is made with a space between said composite strip ends and the splicing pieces are by flexing pressed inwardly into said space.

2. The method of claim 1 in which said length of said carrier strip is made substantially longer than the minimum required to span said joint when the joint is tightly made, and the one of said splicing pieces applied to the outer side of said length of carrier strip is long enough to extend beyond the end of said length of carrier strip so its pressure-sensitive surface is also stuck on the outside of said carrier strip of said other composite strip end.

* * * * *